United States Patent [19]

Guido

[11] Patent Number: 4,700,355

[45] Date of Patent: Oct. 13, 1987

[54] ELECTRICAL MELTING FURNACE EXCHANGEABLE ELECTRODE ASSEMBLY A METHOD FOR CHANGING A CONTACT ELECTRODE ASSEMBLY

[75] Inventor: Heinz Guido, Duisburg, Fed. Rep. of Germany

[73] Assignee: MAN Gutehoffnungshutte GmbH, Fed. Rep. of Germany

[21] Appl. No.: 915,224

[22] Filed: Oct. 3, 1986

[30] Foreign Application Priority Data

Oct. 5, 1985 [DE] Fed. Rep. of Germany ..... 3535692

[51] Int. Cl.[4] ..... H05B 7/02

[52] U.S. Cl. ..... 373/72

[58] Field of Search ..... 373/72, 108

[56] References Cited

U.S. PATENT DOCUMENTS 3,717,713 2/1973 Schlienger ..... 373/72

4,277,638 7/1981 Stenkvist ..... 373/72

FOREIGN PATENT DOCUMENTS 617481 7/1978 U.S.S.R. ..... 373/72

*Primary Examiner*—Roy N. Envall, Jr.

*Attorney, Agent, or Firm*—McGlew and Tuttle

[57] ABSTRACT

A direct current arc or resistance melting furnace includes a contact electrode produced as an exchangeable assembly outside the furnace and introduced into an opening provided in the bottom of the furnace tank. An annular gap between a refractory lining of the furnace tank and the contact electrode assembly is tamped.

For exchanging the contact electrode assembly, it is detached from the lining with the aid of pressure elements (telescoping cylinders) arranged below the furnace tank and lifted upward far enough for the contact electrode to be pulled out of the furnace tank by the grip of a pulling device. Then a new contact electrode assembly is inserted.

5 Claims, 2 Drawing Figures

ELECTRICAL MELTING FURNACE EXCHANGEABLE ELECTRODE ASSEMBLY A METHOD FOR CHANGING A CONTACT ELECTRODE ASSEMBLY

BACKGROUND OF THE INVENTION

1. Field of the Invention

This invention relates in general to electrical melting furnaces and in particular to a new and useful contact electrode assembly and to a method of exchanging it for an electrical melting furnace.

The invention relates particularly to a direct current arc or resistance melting furnace, in particular an exchangeable contact electrode arrangement, the contact electrode comprising a metal support plate, a metal base plate spaced from and connected with the support plate by bolts, one or more metal contact rods having neck portions fastened to the base plate, a refractory tamping between upper contact rods mounted over the base plate and arc support plate, and current and coolant lines arranged below the base plate on the exchangeable electrode arrangement.

During operation of an alternating current arc furnace, reactions to the current supply network occur in the form of asymmetries and flicker. Various possibilities for damping these phenomena are known, inter alia the operation of the arc furnace as a direct current furnace. Through the progress made in the development of semi-conductor components the prerequisites have been created in recent years for the construction of appropriate rectifiers.

The operation of an arc furnace as a d-c furnace with a cathode-poled graphite electrode and an anode-poled contact electrode in the furnace bottom further offers the advantage of considerably reduced graphite electrode consumption. An additional advantage is the clearly lower noise level.

The design and operation of d-c furnaces are known from many publications. The structural part essential to the practical operation of the furnace is the contact electrode in the furnace tank, which must ensure both good electrical contact with the charged scrap or, in the subsequent melting process, with the liquid metal, and must also withstand high thermal load.

A similar contact electrode is known from DE-PS 31 06 741.

The contact electrodes in the d-c arc furnace are subject to wear earlier than the furnace hearth lining. Since the changing of individual contact rods requires substantial labor, the method has been adopted of exchanging all contact rods jointly at appropriate intervals of time.

In the procedure followed until now, a suitable pulling lug was placed in the small amount of residual melt remaining in the furnace, after the last melt. After its cooling and solidification, the residual melt, contact rods and lining can then be pulled by means of a suitable device. Thereafter new contact rods are inserted and the center of the furnace bottom is tamped anew.

This procedure has the drawback that insertion of the contact rods, tamping of the center of the furnace bottom, and the following drying of the taping composition, delay the restarting of the furnace. Also tamping of the center of the furnace bottom inside the hot furnace is difficult for the personnel.

SUMMARY OF THE INVENTION

The invention provides an improved contact electrode arrangement over that proposed in DE-PS 31 06 741 so as to achieve simpler and faster production, assembly and disassembly.

Accordingly, the contact electrode arrangement is constructed as a complete component of the melting furnace. For inserting this component into the furnace tank, provided with a circular opening at the bottom, a crane is used. For the lifting in, carrying means (lugs) are let in at the top of the contact electrode assembly. The assembly is lowered into the furnace tank and sets down with its support plate on the annular reinforcement in the furnace tank. The base plate, where the current and coolant lines are connected, "hangs through" i.e., downwardly through the furnace tank opening.

The carrying means at the top of the contact electrode assembly have fulfilled their function after the assembly has been lowered and set down on the furnace tank bottom and they melt during operation of the furnace.

Changing of the contact electrode assembly becomes necessary after burnoff of the contact rods.

After the furnace has run empty, the pressure elements (telescoping cylinders) mounted on the brackets below the furnace tank are moved out upwardly. Thus first the contact electrode is broken out of the tamping composition with a great pressure force and is then pushed up far enough for the grip of a pulling means present above the opened furnace to embrace the contact electrode and to pull it out of the furnace upwardly.

This having been done, a new contact electrode assembly is inserted in the annular gap between the refractory lining of the furnace tank and the mounted contact electrode assembly tamped with refractory material.

Alternatively the changing of the contact electrode assembly may take place by leaving on the hearth bottom of the furnace, after the last charge, a residual melt and inserting suitable carrying lugs therein. These lugs take hold after the melt has cooled. The contact electrode having merely been broken out of the bond in the furnace tank by means of the pressure elements (telescoping cylinders), the carrying lugs have sufficient hold in the residual melt above the contact electrode, so that the contact electrode, already detached from the furnace tank, can readily be extracted upwardly by a pulling means. Thereafter, the inserting of a new contact electrode assembly can take place in the manner already described.

Accordingly it is an object of the invention to provide an improved electrical melting furnace contact electrode assembly construction which comprises an exchangeable assembly arranged in an opening of a melting furnace bottom in which includes at least one contact rod fastened to a base plate which has a refractory tamping around the rod which is secured to a base plate in which includes a support bracket that connected to the base plate having a downwardly extending annular reinforcement with a pressure element mounted thereon.

A further object of the invention is to provide an improved method of exchanging a contact electrode assembly which comprises using a pressure element mounted on brackets of the assembly to detach a tamp lining from the furnace and to lift the assembly upwardly by a grip of a pulling means and by replacing it with a new contact electrode assembly which is inserted into the tank from above.

A further object of the invention is to provide a contact assembly for an electric furnace which is simple in design rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF THE PREFERRED EMBODIMENTS

Figure 1:
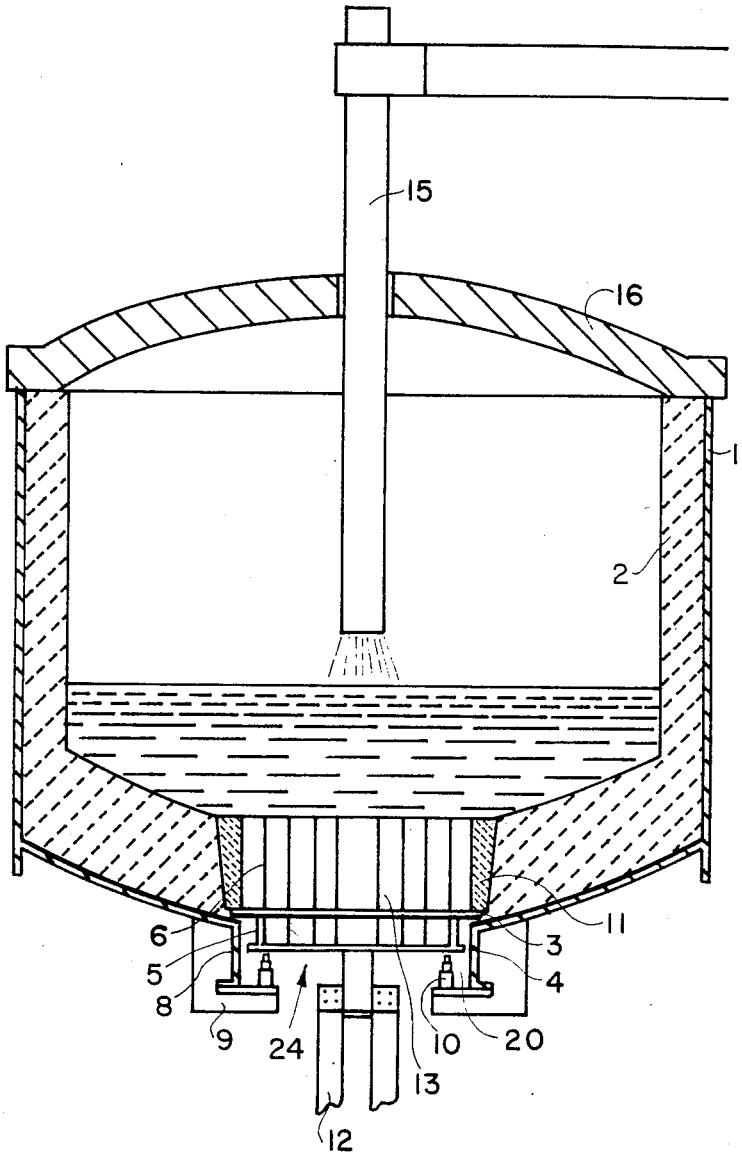
FIG. 1 shows a section through a d-c arc furnace with contact electrode arrangement in the operating state and constructed in accordance with the invention.
Figure 2:
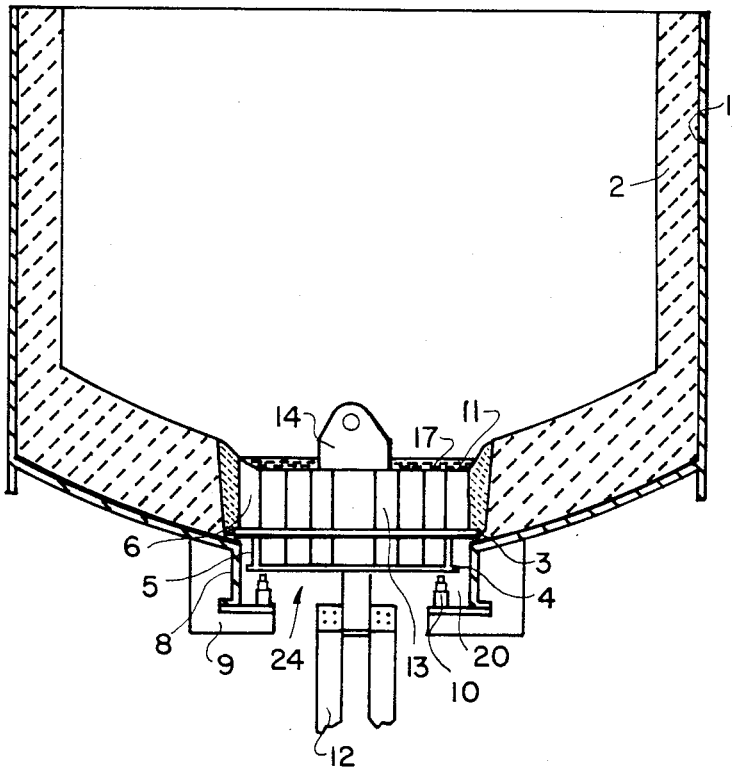
FIG. 2 is a section through a furnace according to FIG. 1, but before the changing of the contact electrode arrangement.

Referring to the drawings in particular the invention embodied therein as shown in FIGS. 1 and 2 comprises a method and apparatus for installing and or removing a contact assembly designated 24 from an opening 20 in a bottom of an electrical furnace tank or vessel 1 which has a refractory lining 2 a furnace cover 16 at the top of the vessel 1 and a melting electrode 15 protruding through the tank for vessel 1 into the interior of vessel 1.

The furnace tank or vessel of a d-c arc furnace illustrated in the figures has a steel jacket 1 and a steel tank bottom 7. The tank is provided with a refractory lining 2.

As shown in FIG. 1, a contact electrode is inserted in a circular bottom cutout 20 of the furnace tank as a compact assembly 24.

The contact electrode assembly 24 is fully assembled outside the furnace. The assembly 24 comprises a support plate 3, and a base plate 4 spaced therebelow and connected with the support plate 3 by bolts 5. Metal contact rods 6 are secured to the base plate 4 by their necks, standing upright. The space 13 of the contact electrode between the rods and from the upper edge of the contact rods 6 up to the support plate 3 is tamped by placing a template around the contact electrode, which is removed again after the tamping has solidified.

At its top the contact electrode assembly receives at least one carrying means in the form of a lug 14 to which hooks of the pulling means are fitted, by which the complete contact electrode assembly is lowered into the furnace tank from above. The contact electrode with its support plate 3 is set down on the edge of the bottom cutout in the form of a circular ring and is connected with the furnace tank by suitable means.

The contact electrode assembly having been inserted, the annular gap 11 between the inserted assembly and the refractory lining 2 of the furnace tank 1 is tamped with refractory material. The carrying lugs 14 melt in the first furnace operation.

The changing of the spent contact electrode is done by removing upwardly pressure elements or telescoping cylinders (10) present on the brackets 9 of the annular reinforcement 8 below the furnace tank after the furnace has run empty and breaking the complete contact electrode assembly out of the tamping union with the furnace tank. As soon as the breaking out has taken place, the telescoping cylinders can be moved out farther, so that the contact electrode protrudes from the hearth bottom of the furnace tank far enough for it to be gripped and pulled out by the grip of a crane (not shown), located above the opened furnace.

As alternative for the changing of the contact electrode assembly provides that after the last furnace charge a residual melt 17 is left in the hearth bottom. Into this residual melt 17 at least one carrying lug 14 is let in, to which, after the residual melt 17 has cooled, a pulling means is fitted which pulls the contact electrode assembly out of the furnace tank upwardly, the contact electrode having previously with the aid of the pressure elements 10 (telescoping cylinders) disposed below the furnace tank, been broken out of the union with the furnace tank by upward movement of the telescoping cylinders.

What is claimed is:

1. A contact electrode assembly for a direct current electrical melting furnace, having a vessel with a central bottom opening, comprising: an exchangeable contact electrode arrangement positionable within the opening including a metal support plate, a metal base plate space from said support plate and connected to said support plate, at least one metal contact rod fastened to said base plate, a refractory tamping around said at least one rod, from its upper edge to said support plate, said electrode arrangement connected to said support plate; a support bracket, connected to the vessel, having a downwardly extending annular reinforcement; and pressure element means, mounted on said reinforcement, for engaging said electrode arrangement and moving said electrode arrangement upwardly.

2. A contact electrode assembly according to claim 1 further comprising: a carrying element, connected to the top of said contact electrode arrangement.

3. A contact electrode assembly according to claim 1 wherein: the length and width dimensions of said contact electrode arrangement are smaller than the length and width dimensions of the central bottom opening, so as to provide an annular gap between the contact electrode arrangement and the wall of said furnace vessel surrounding the bottom opening thereof and including a refractory lining in said furnace vessel around said contact electrode arrangement said refractory lining being tamped.

4. A method of changing a contact electrode arrangement in a contact electrode assembly which includes a vessel with a central bottom opening and a contact electrode arrangement having a dimension smaller than the furnace central bottom opening so as to form an annular gap between the furnace vessel surrounding the bottom opening and the contact electrode arrangement the assembly also including a refractory lining positioned in said annular gap, a bracket connected to the vessel having a downwardly extending annular reinforcement and a pressure element mounted on the reinforcement, the method comprising the steps of: detaching the lining by means of the pressure element mounted on the bracket; and, lifting and extracting the assembly upwardly to the top of the vessel.

5. The method according to claim 4 further comprising the steps of: carrying the contact electrode arrangement out of the vessel and installing a new contact electrode arrangement into the furnace vessel from above.

* * * * *